United States Patent [19]

Abe et al.

[11] Patent Number: 4,819,556

[45] Date of Patent: Apr. 11, 1989

[54] SHUTTLE PRINTER WHICH STOPS SHUTTLE FOR PAPER FEED

[75] Inventors: Akihiro Abe, Yokohama; Akinori Kamata, Kawasaki; Satoshi Yoshino, Kawasaki; Hirotomo Terada, Kawasaki, all of Japan

[73] Assignee: Fujitsu Limited, Kawasaki, Japan

[21] Appl. No.: 117,570

[22] Filed: Nov. 6, 1987

[30] Foreign Application Priority Data

Nov. 7, 1986 [JP] Japan ..... 61-264032
Dec. 17, 1986 [JP] Japan ..... 61-302108

[51] Int. Cl.[4] ..... B41J 3/12

[52] U.S. Cl. ..... 101/93.04; 400/121; 400/322; 400/328; 400/568

[58] Field of Search ..... 101/93.04, 93.05, 93.09; 400/121, 124, 322, 323, 328, 568, 902

[56] References Cited

U.S. PATENT DOCUMENTS 3,764,994 10/1973 Brooks et al. ..... 400/323
4,415,286 11/1983 Jennings ..... 101/93.04

FOREIGN PATENT DOCUMENTS 108182 6/1983 Japan ..... 400/323
183164 9/1985 Japan ..... 400/323
167569 7/1986 Japan ..... 400/323
169258 7/1986 Japan ..... 101/93.04

*Primary Examiner*—David A. Wiecking
*Attorney, Agent, or Firm*—Staas & Halsey

[57] ABSTRACT

A line printer apparatus with which a printing control operation is carried out by using a printing mechanism and printing operation control unit in which the reversal of the motion of a printing unit is carried out in synchronization with the feeding of a paper to be printed. The apparatus includes a decision unit for deciding whether or not a shuttle carrying the printing unit should be stopped during the reversal of the motion in accordance with printing information supplied to a unit for controlling the driving of the shuttle and the condition of feeding of the paper; reversing motion stopping means for stopping the reversing motion of the printing unit and holding it in the stopped state by supplying reversing stopping information to the printing operation control means when the paper feeding time of the paper to be printed is greater than the time of the reversing motion of the printing unit; and releasing means for releasing the stopping of the reversing motion of the printing unit in relation to the timing of termination of paper feeding of the paper to be printed and restarting the printing from a printing starting position. Therefore, the printing operation is restarted immediately after the termination of a paper feeding operation even when the time of the paper feeding is longer than the time of reversing motion of the printing unit.

8 Claims, 20 Drawing Sheets

Fig. 2
(1) SCAN AND PRINT STARTING POSITION
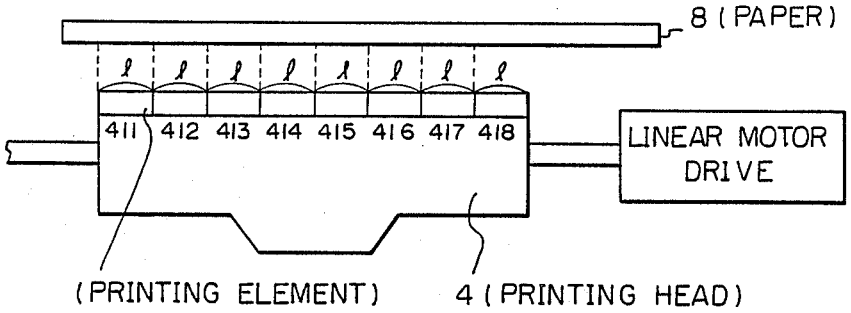
(2) FORWARD SCAN AND PRINT TERMINATION POSITION
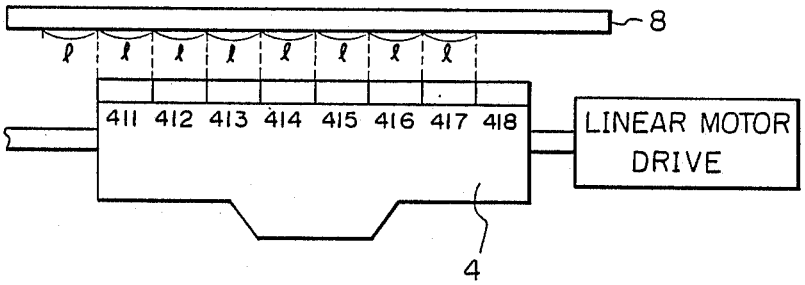
(3) BACKWARD SCAN AND PRINT TERMINATION POSITION
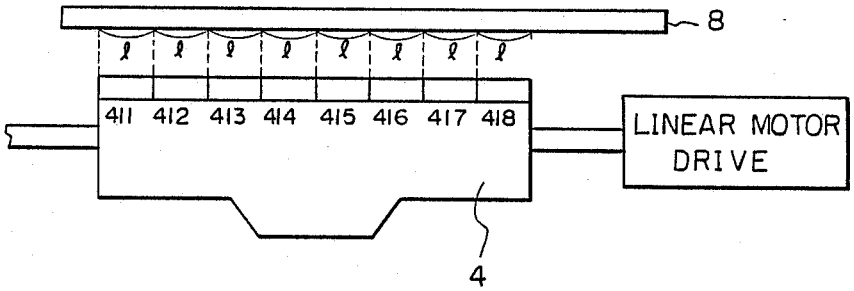

| Fig. 9A |
| --- |
| Fig. 9B |

SHUTTLE CONTROL

Fig. 12 OUTPUT OF POSITION SENSOR
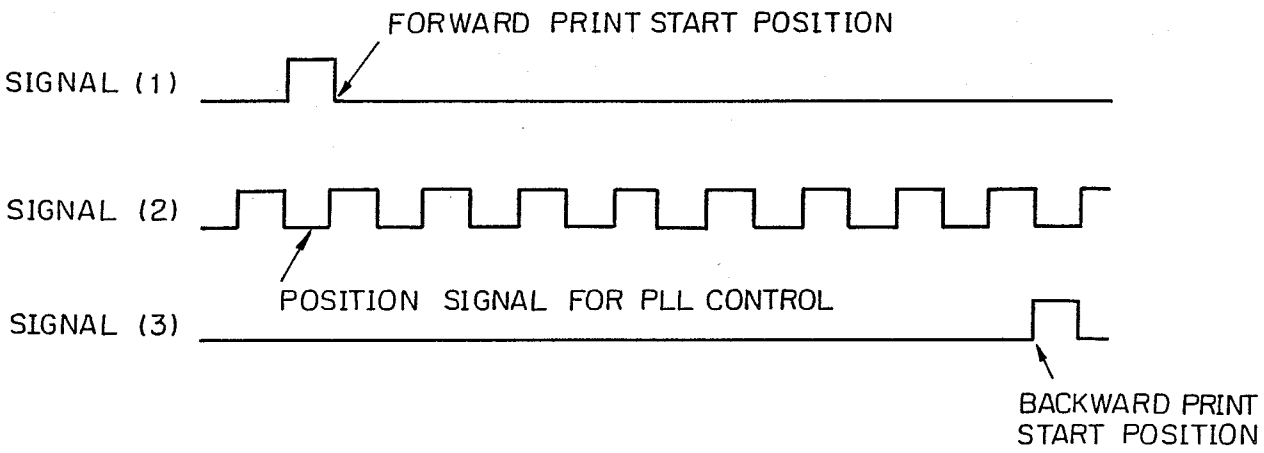

Fig. 13 PLL CONTROL
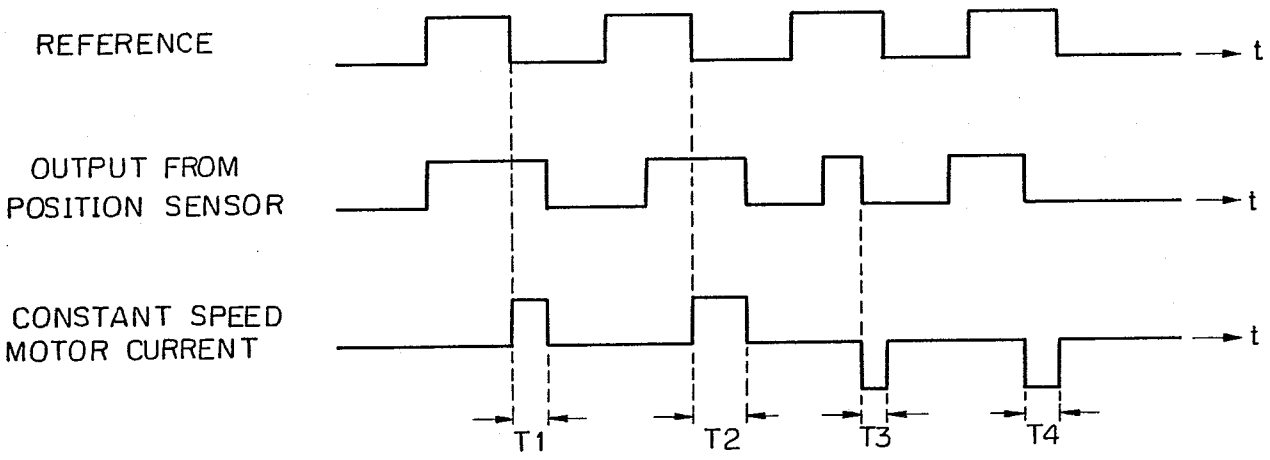

Fig. 14 REVERSING MOTION CONTROL
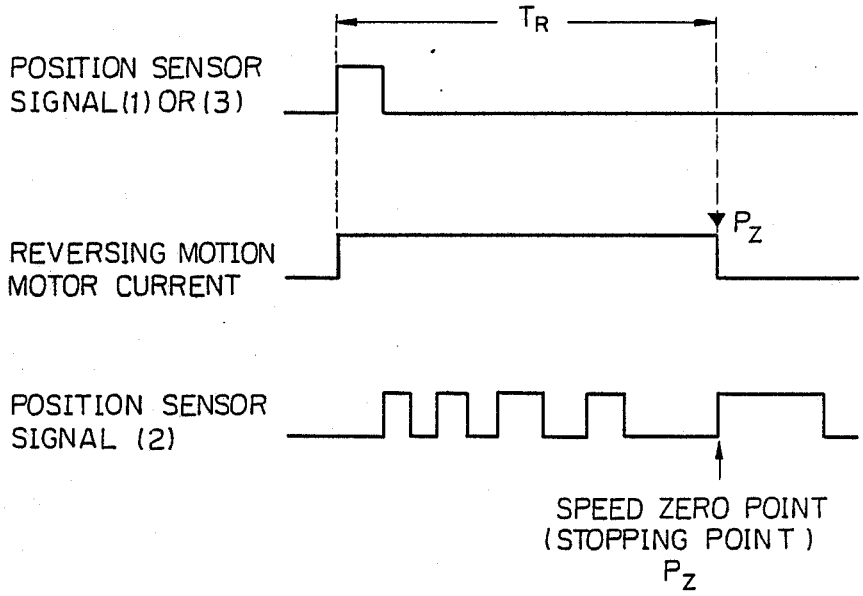
Fig. 15 STOPPING CONTROL
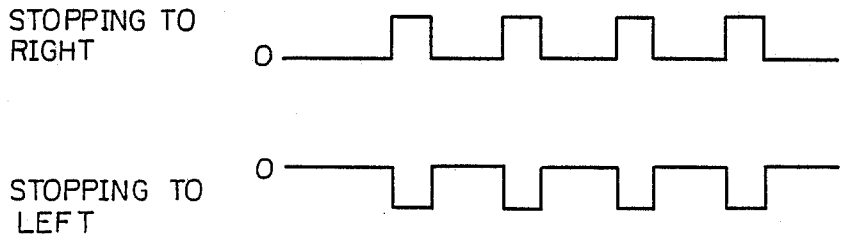

SHUTTLE PRINTER WHICH STOPS SHUTTLE FOR PAPER FEED

BACKGROUND OF THE INVENTION

1. Field of the Invention

The present invention relates to a dot matrix line printer, and more particularly, to a line printer to which a pulse excitation is applied and a printing head is scanned horizontally to print with a high speed and an enhanced efficiency and the noise and vibration thereof is absorbed.

2. Description of the Related Art

Wire-dot line printers are widely utilized in the field of data-processing devices, computers or telecommunication utilities. In this type of printer, a plurality of wire-dot printing heads are mounted to a shuttle at an appropriate distance, and the shuttle is moved at regular intervals of the head and the printer prints out Chinese characters or other characters for a plurality of lines at one time. When a printing of one dot line is completed, a print paper is fed for a single line spacing, the movement of the shuttle is reversed to print the next line, and thus by repeating such operation, lines can be printed one-by-one. Accordingly, a drive unit is provided in the shuttle to cause a reciprocal motion of the shuttle.

In the known prior art a shuttle drive unit for the above-described line printer is constituted by a direct-current linear motor arranged in the shuttle as a driving means and a drive signal is input to the linear motor from the driver unit to drive the linear motor. Further, the driver control means is formed by microprocessors to control the driver unit. A sensor is provided for detecting the position of the shuttle in the printer, which feeds back the position signal to control the driver control means.

The above-described driver control means controls the driver unit to enable the shuttle to implement the following two operations. That is, first, the operation of the shuttle while the line printer is printing; i.e., the shuttle is made to travel at a constant velocity in two directions, and, second, the motion of the shuttle from one print position to the following print position; that is, a reversal of the motion, is carried out during a time interval of from the time when the constant speed travel in one direction is finished, to the time when the next constant speed travel is commenced.

This control causes a drive signal to be output from the driver to a linear motor of the shuttle and printing by the printer is enabled by the reciprocal motion of the shuttle.

The printer conventionally carries out the printing in accordance with information transferred from a host computer. Thus, the printer can execute printing for one line only when at least one line of printing information is stored in a buffer memory of the printer. Therefore, if the timing when one line of printing information stored in the buffer is completed coincides with the timing of the reciprocal movement of the shuttle, the shuttle can implement printing by a forward movement and a backward movement.

When these timings deviate from the normal routine, due to circumstances beyond control, printing can not be implemented even if the shuttle is in motion. That is, even when the shuttle starts to travel, if one line of printing information is not yet stored, storing of the printing information in the printer is completed during the travel of the shuttle motor unit. As a result, printing of that information can not be implemented during the travel of the shuttle and during the next travel of the shuttle, the printing based on the printing information is implemented, and under these circumstances the overall printing speed is reduced.

Further, when printing is implemented by a printer, sometimes a comparatively longer paper feed time is necessary, and in this case, an unnecessary printing of dot lines by the reciprocal movement of the shuttle is carried out.

SUMMARY OF THE INVENTION

Therefore, in accordance with the present invention, there is provided a line printer apparatus with which a printing control operation is carried out by using printing mechanism and printing operation control means in which a reversing motion of a printing unit is carried out in synchronization with a feeding of a paper to be printed. The apparatus includes decision means for deciding whether or not the printing unit should be stopped during the reversing motion in accordance with printing information supplied to means for controlling the driving of the printing unit and the condition of feeding the paper; reversing motion stopping means for stopping the reversing motion of the printing unit and holding it in the stopped state by supplying reversing motion stopping information to the printing operation control means when the paper feeding time of the paper to be printed is greater than the time of the reversing motion of the printing unit; and releasing means for releasing the stopping of the reversing motion of the printing unit in relation to the timing of termination of paper feeding of the paper to be printed and restarting the printing from a printing start position; whereby the printing operation is restarted immediately after the termination of a paper feeding operation even when the time of the paper feeding is longer than the time of reversing motion of the printing unit.

In accordance with the present invention, when printing information is not input or a print out thereof is not necessary, the decision means of the driver control means decides to stop the motion of a shuttle carrying the printing unit and the stopping means causes the driver to output a shuttle drive signal for driving the shuttle to press onto one of the dampers arranged against the shuttle to hold the shuttle in the stopped state.

Therefore, the shuttle is maintained in the stopped state while the paper is being fed. The printing can be carried out after the feeding of the paper is terminated and printing information is supplied.

BRIEF DESCRIPTION OF THE DRAWINGS

FIG. 2 illustrates the motion of the printing head with respect to the paper to be printed;

FIG. 12 shows waveforms of the output signals of the position sensor;

FIG. 13 shows waveforms of the output of the sensor output and the current of the constant speed motor;

FIG. 14 shows waveforms for reversal control;

FIG. 15 shows waveforms for stopping control;

DESCRIPTION OF THE PREFERRED EMBODIMENTS

Before describing the preferred embodiments of the present invention, the general structure and operation of a line printer to which the present invention is applied, and the operation of a prior art line printer, are described with reference to FIGS. 1A, 1B, 2, 3, and 4.

Figure 1A:
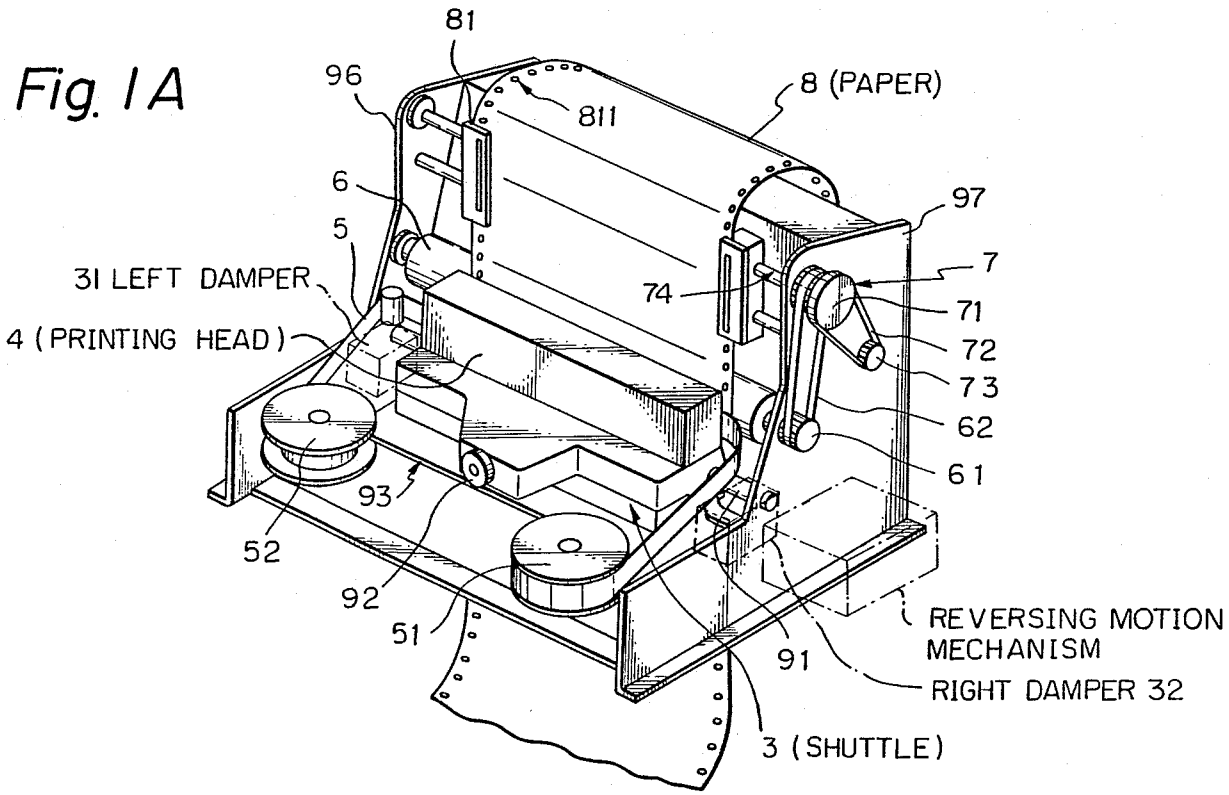
FIG. 1A is a perspective view of a line printer to which the present invention is applied.

FIG. 1A is an overall perspective view of a line printer to which the present invention is applied. The line printer includes a shuttle 3, a printing head 4, a linear motor for driving (shown in FIG. 6), an ink ribbon 5 which is delivered between the printing head 4 and a paper 8 by ink ribbon feeders 51 and 52, a platen 6 which is mounted against the printing head 4 through the paper and is rotatably driven by a gear 61 and a timing belt 62 at an end thereof. A left damper 31 and a right damper 32 are arranged at both sides of the shuttle 3. The line printer also includes a paper feed mechanism 7 which includes a motor 102 (shown in FIG. 5A) coupled with a gear 73 through a gear 71 and a timing belt 72 to rotate a tractor shaft 74. The paper feed mechanism 7 drives a platen 6 and a tractor 81 to feed a paper 8 to be printed. A tractor 81 is mounted on the upper part of the platen 6 and is associated with a sprocket hole 811 of the paper 8 to feed the paper 8 in an upward direction. Frames 96 and 97 support each part of the paper feed mechanism 7 and a guide shaft 91 is arranged between the frames 96 and 97 to operate as a mobile guide of the printing head 4. A guide roller 92 is arranged at the rear part of the printing head 4 to slide on a base plate 93.

The linear motor is comprised of a flat coil mounted at the printing head side and a permanent magnet fixed on a base plate between the frames 96 and 97. A reversing motion mechanism, which is coupled with a counterbalancer for balancing the printing head 4, is arranged to reverse the motion of the printing head and balancer. The above-noted reversing mechanism is disclosed in Japanese Unexamined Patent Publication (Kokai) No. 62-93567.

Figure 1B:
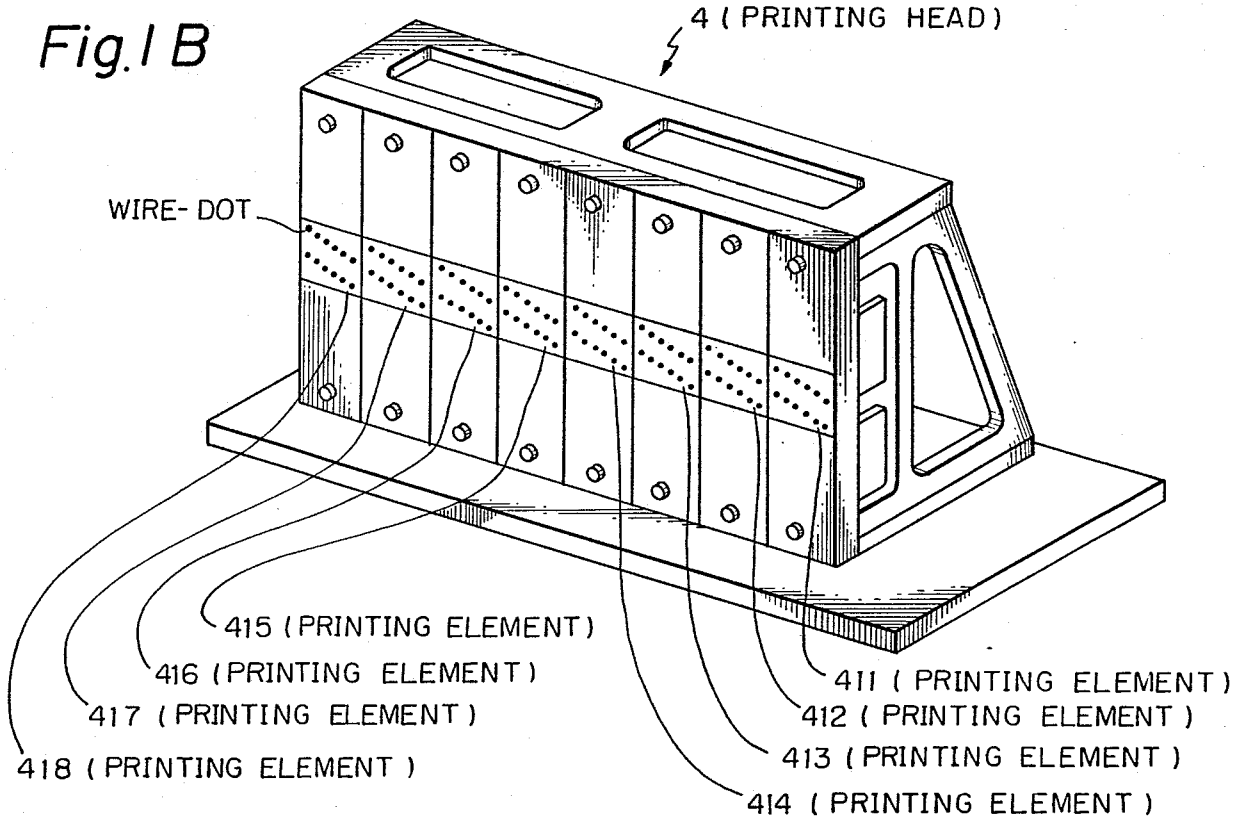
FIG. 1B is a perspective view of a printing head in the line printer of FIG. 1A.

As shown in FIG. 1B, the printing head 4 has a plurality of print blocks or printing elements 411 through 418 on each of which two rows of 6 wire-dots are arranged at a slant. Therefore, printing by 12 wire-dots in the vertical direction is carried out. The paper to be printed is fed by the platen 6 which is driven by the paper feed mechanism 7, and the tractor 81. The printing is carried out by the print head 4 through the ink ribbon 5.

The printing head 4 is guided by a guide shaft 91 and a guide roller 92 and is moved rightward or leftward by a linear motor. A wire-dot of the printing head 4 strikes the platen 6 through the ink ribbon 5 and carries out printing of a dot on the paper.

As shown in FIG. 2, provided in the printing head 4 are a sequence of wire-dot type printing elements 411, 412, 413, 414, 415, 416, 417 and 418 having equal longitudinal lengths (l) for carrying out printing on the paper 8. The printing elements 411 through 418 move for the lateral length l along the lateral direction of the paper 8 and carry out printing on the paper 8. Each of the printing elements 411 through 418 carries out printing on the paper 8 for the lateral length l. Thus the length l is a stroke of the printing head 4 which is equal to the lateral length of printing by one printing element on the paper.

As shown in FIG. 2, from the position (1) of scan and print starting to the position (2) of forward scan and print termination, a forward scan and print is carried out by the series of printing elements on the paper. From the position (2) of the forward scan and print termination to the position (3) of the backward scan and print termination, a backward scan and print is carried out by the series of printing elements on the paper. The position (3) is the same as the position (1).

Figure 3:
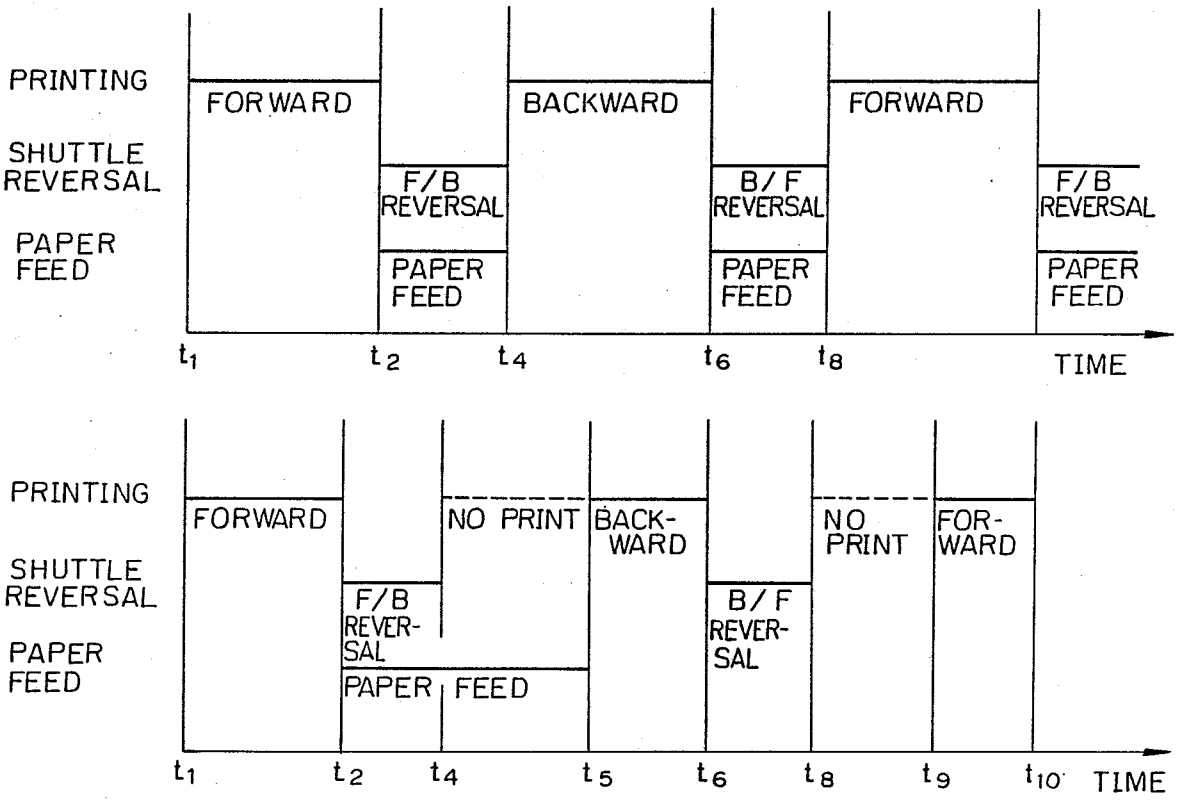
Fig. 3 PRIOR ART
FIG. 3 illustrates the timing of the operation of a prior art line printer.
Figure 3:
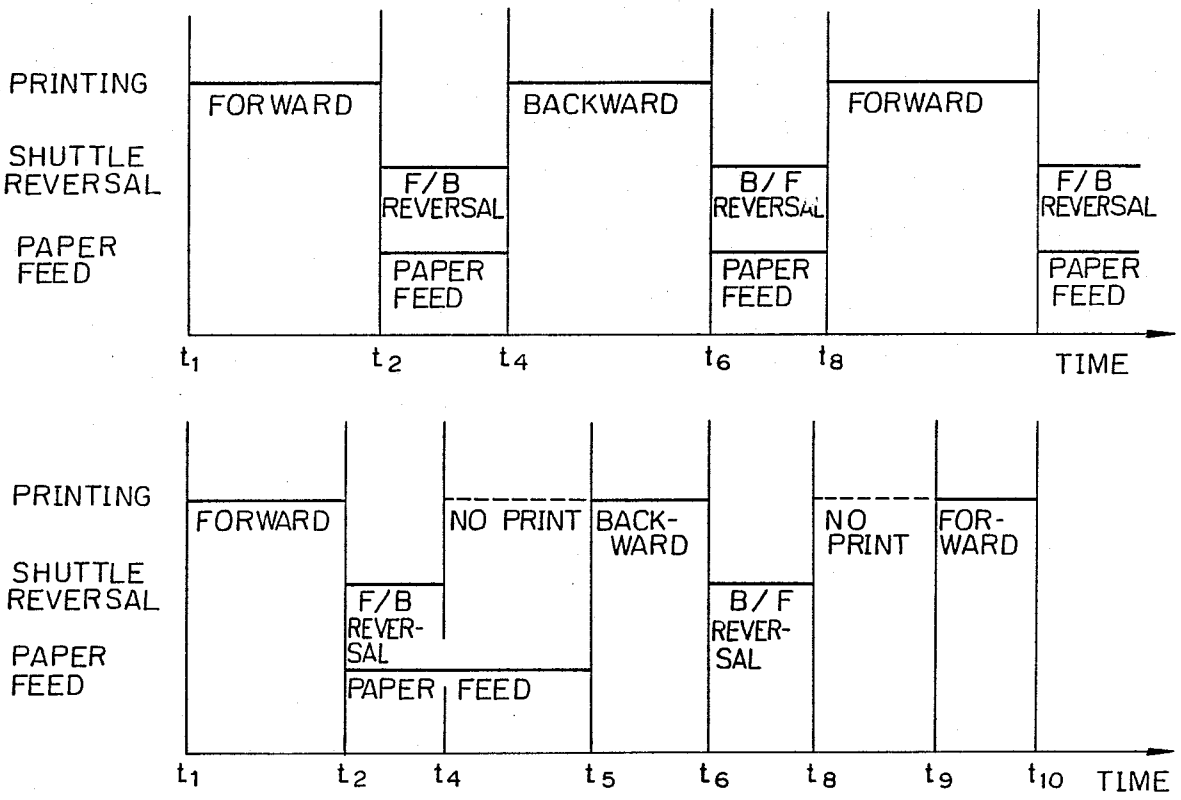
Fig. 3 PRIOR ART

FIG. 3 illustrates the operation of the timing of a prior art line printer. The upper part of FIG. 3 shows the timing chart for printing, the shuttle reversal motion, and the paper feed. In this case the reversal motion and the paper feed are carried out between the forward motion and the backward motion and the reversing time is equal to the paper feed time. The lower part of FIG. 3 shows the case when the paper feed time is longer than the reversing time.

Figure 4:
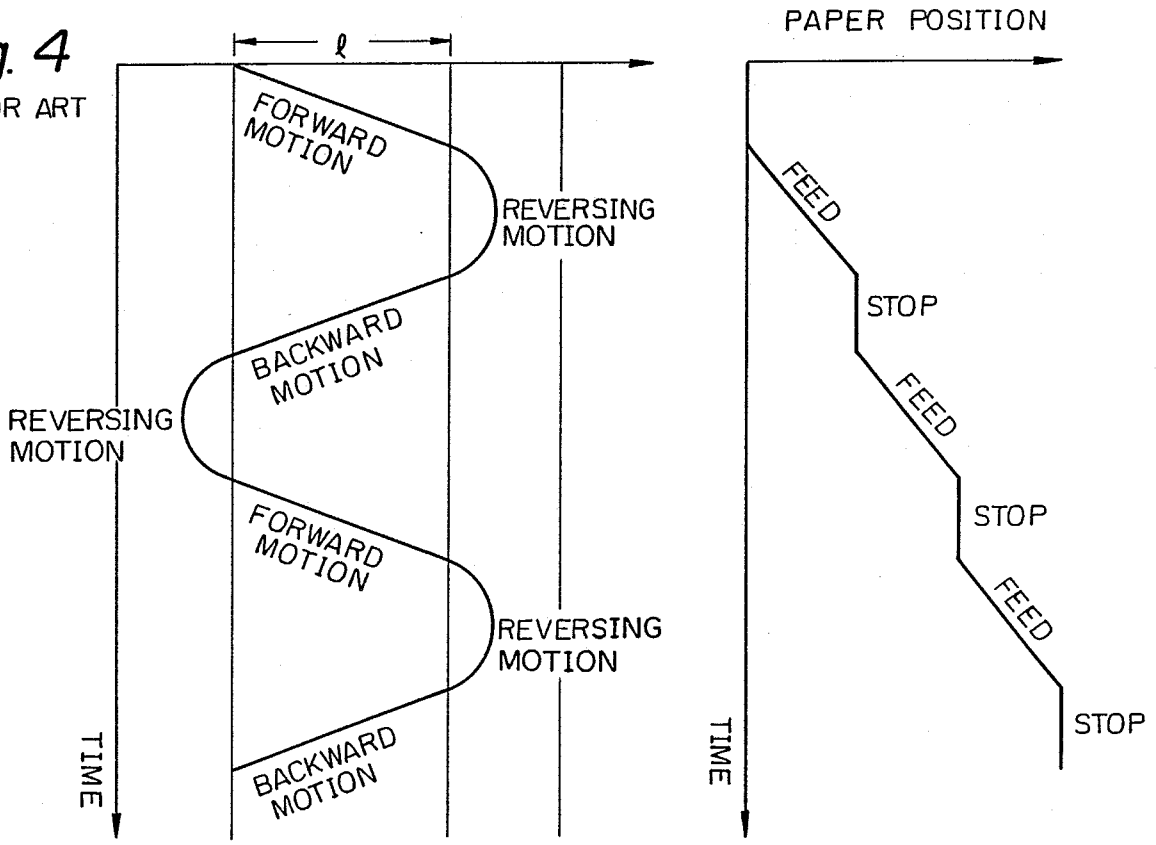
Fig. 4 PRIOR ART
FIG. 4 illustrates the motion of the printing head of a prior art line printer.

FIG. 4 illustrates the motion of the printing head of a prior art line printer. In the left part of FIG. 4, there is shown the change with time of the position of the shuttle, while in the right part of FIG. 4, there is shown the corresponding change of the position of the paper. In the right part of FIG. 4, the motion of the paper is illustrated in which the paper feed operation and paper feed stopping are carried out alternately. As shown in the left part of FIG. 4, a forward motion, a reversing motion, a backward motion, and another reversing motion of the shuttle are carried out.

Figure 5A:
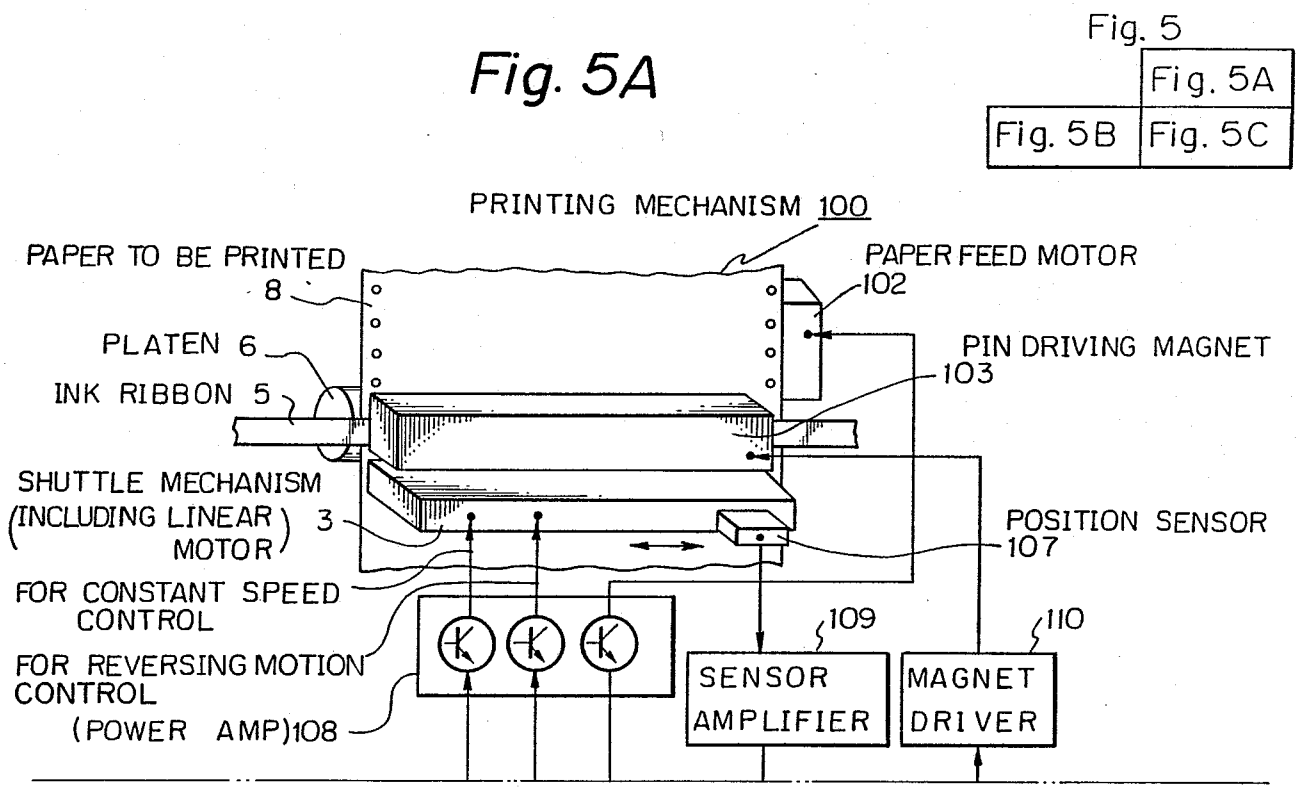
FIGS. 5A, 5B and 5C are a schematic block diagram of a line printer apparatus according to an embodiment of the present invention.
Figure 5B:
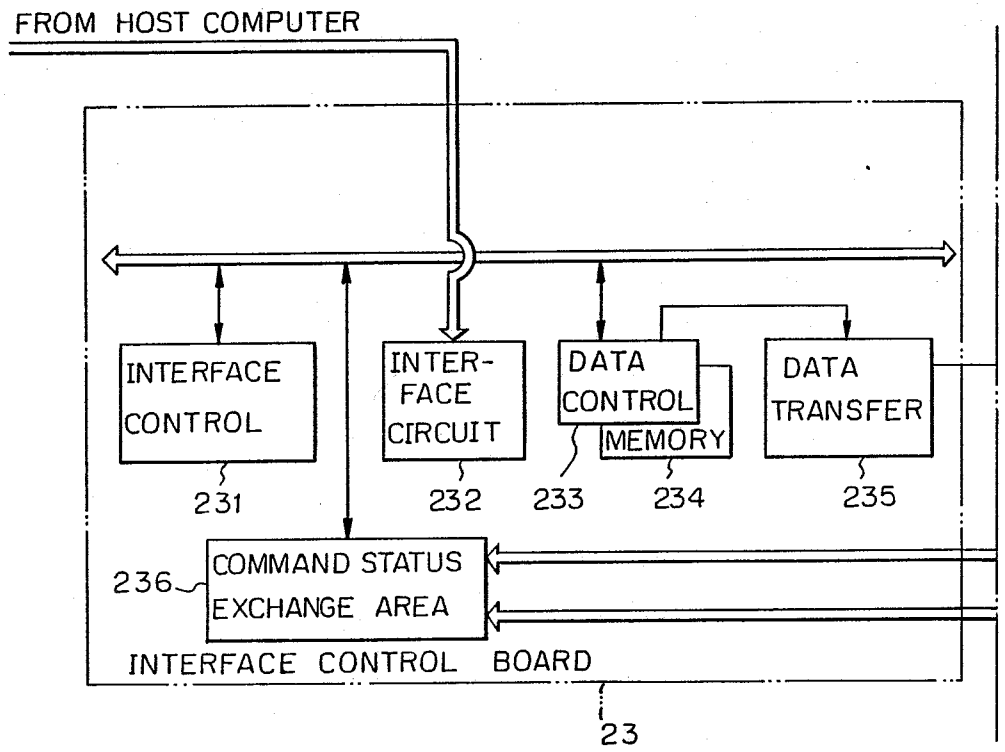
Figure 5C:
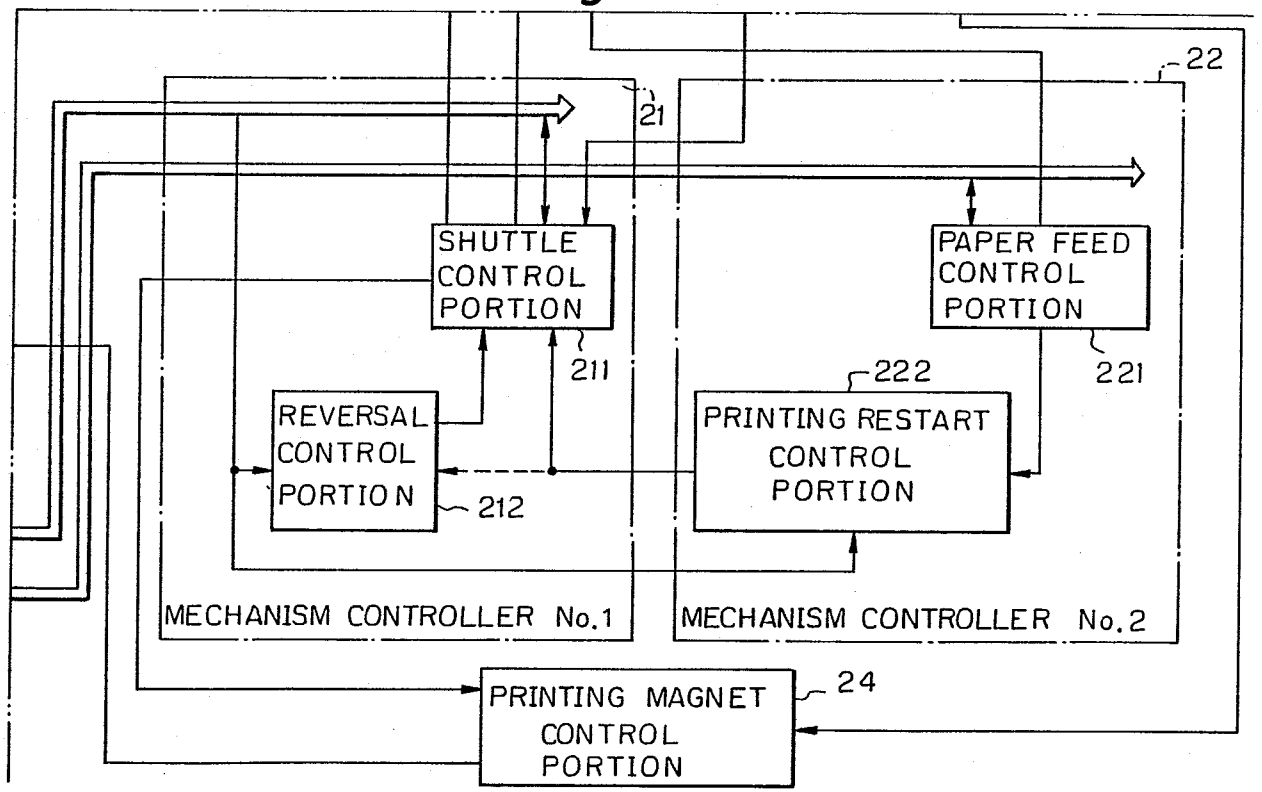
Figure 6:
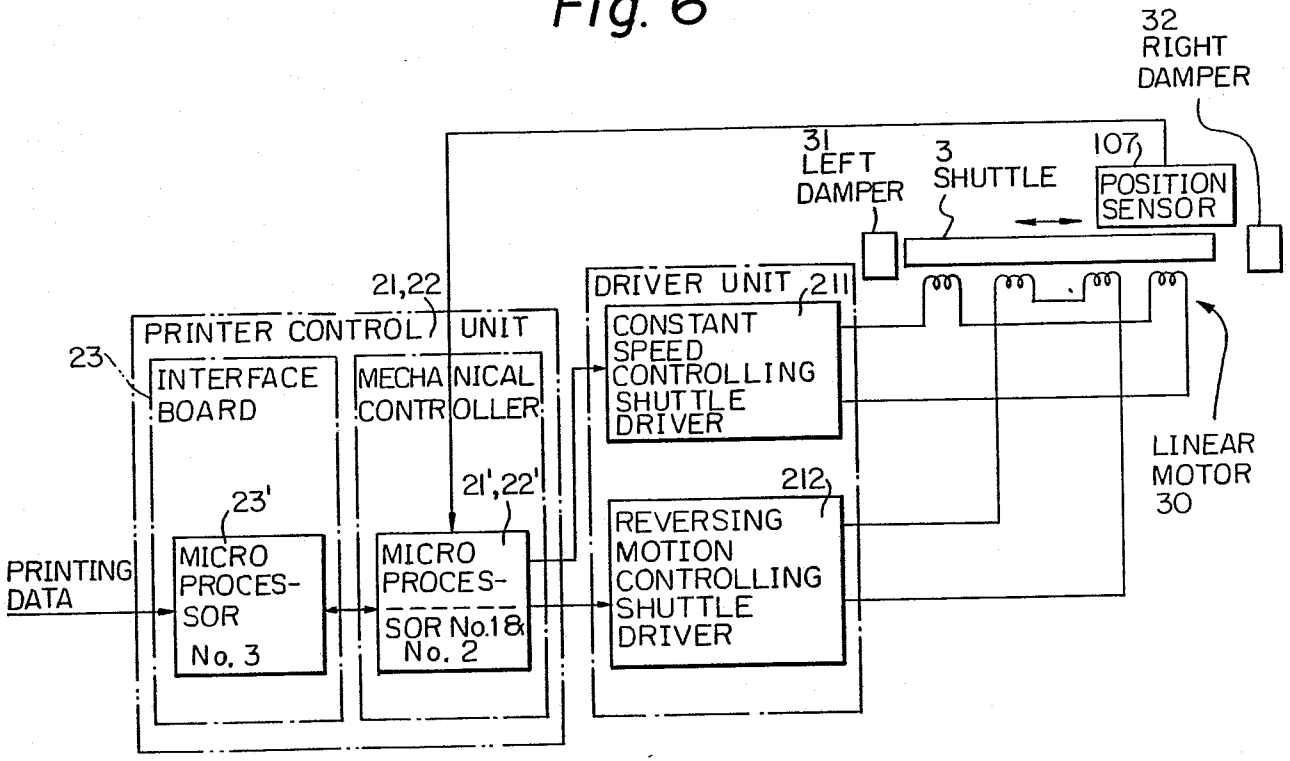
FIG. 6 shows the structure in the line printer apparatus of FIG. 5, to illustrate the mechanism for driving the shuttle.
Figure 7:
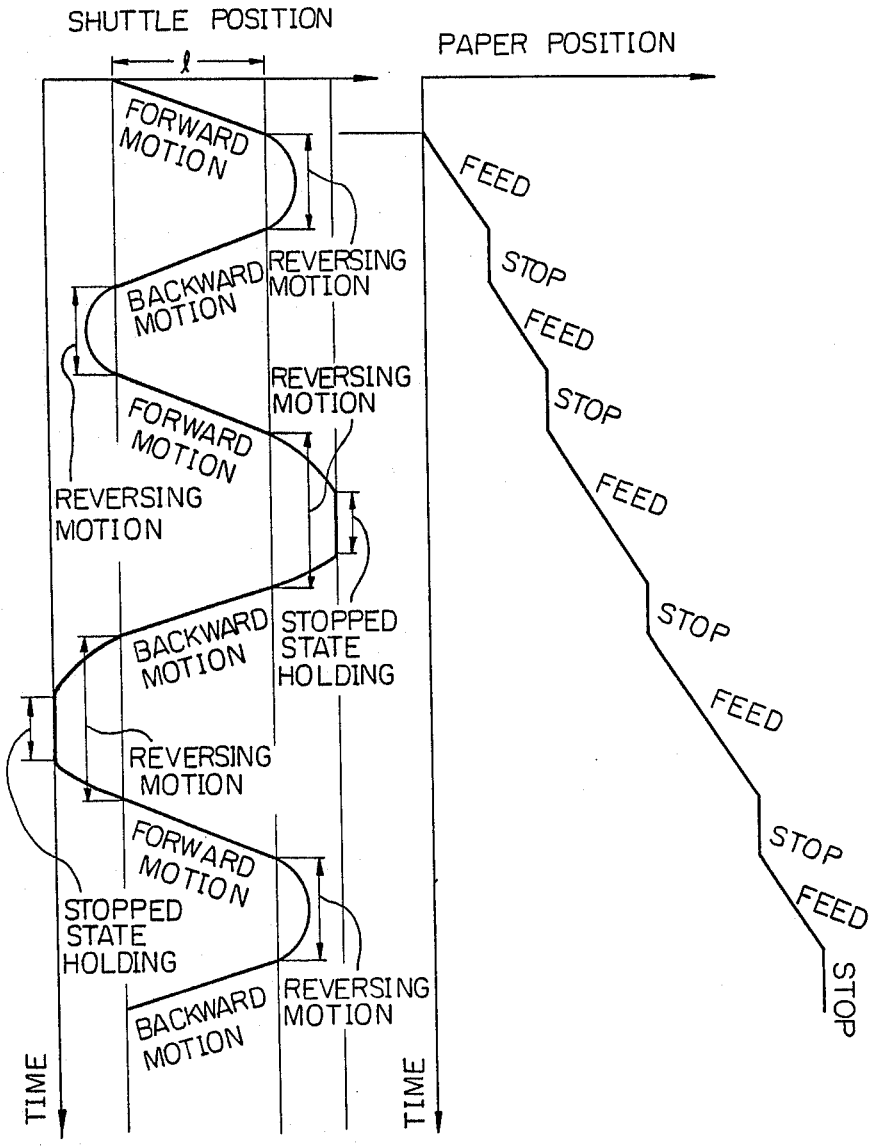
FIG. 7 illustrates the operation of the apparatus of FIG. 5.

A schematic block diagram of a line printer apparatus according to an embodiment of the present invention is shown in FIGS. 5A, 5B and 5C. The structure in the line printer apparatus of FIGS. 5A, 5B and 5C for illustrating the mechanism for driving the shuttle is shown in FIG. 6.

A schematic block diagram of a line printer apparatus according to an embodiment of the invention is shown in FIGS. 5A, 5B and 5C. In the printing mechanism 100 shown in FIG. 5A, 8 is a paper to be printed, 102 is a paper feed motor in a paper feed mechanism which delivers the paper for a predetermined line spacing, 103 is a pin driving magnet which drives a plurality of print units (not shown) for printing by a wire dot method, to print thereof. A shuttle motor in a shuttle mechanism 3 causes a reciprocating motion of the printing unit through the section equivalent to the print interval.

The printing unit prints one line for each forward and each backward path respectively. Shown in FIG. 5A is a platen 6, an ink ribbon 5, and a position sensor 107 which detects a print start position, a reversing motion termination position, a print termination position and a reversing motion start position. As described above, the printing mechanism 100 forms a line printer with which a reciprocating printing is carried out by wire dots.

The printer control units, are provided with a respective mechanism control portion No. 1 and No. 2 and a shuttle control unit for controlling the operation of the shuttle motor. Each output signal of the position sensor 107, a printing restart control unit 222 and a reversal control unit 212 is delivered to the shuttle control portion 211.

A printing magnet control portion 24 controls the operation of the pin driving magnet 103. A paper feed control portion 221 controls the operation of the paper feed motor 102 and the output signal of the paper feed control portion 221 is applied to the printing restart control portion 222. The interface control board 23 includes an interface control unit 231, and interface circuit 232, a data control unit 233 and a memory 234. The interface board 23 controls the whole operation of microprocessors 21, 22 and 24 as a printer control means.

When a line of printing is completed, both printing control data containing information indicating the following line to be printed and print information in which a printing code etc., are set, are delivered.

The interface control board 23 forms predetermined print data, based upon the print code and transmits print control data to the reversal control portion 212.

To illustrate the mechanism for driving the shuttle, the structure in the line printer apparatus of FIG. 5 is shown in FIG. 6.

In FIG. 6, the shuttle 3 is moved reciprocally between a pair of dampers 31 and 32 by a d.c. linear motor, 30 and the motor is actuated by a driving signal from a driver unit supplied to the motor winding. A position sensor mounted on the upper part of the shuttle mechanism 3 detects the position of the shuttle.

The driver means is controlled by a printer control unit composed of three microprocessors 21', 22' and 23'. The printer control unit operates as a driver control means for controlling the driver unit and as a control means for controlling the whole printer apparatus, and operates as both a decision means and a stopping means.

A first microprocessor 21' mounted on the driver unit side between three microprocessors 21', 22' and 23' compares a command of the third microprocessor 23' receiving printing data from a host computer, with the position information of the shuttle detected by the position sensor, to generate the following three kinds of control signals in the driver unit.

Signal (1) represents the operation of the shuttle where the printer is now printing, that is, the shuttle is moved in one direction and in the counter direction at a constant speed.

Signal (2) represents the operation of the shuttle, the position of which responds to an interval between one print of the printer and the following print, that is, the shuttle travels in a reverse direction from a time when the shuttle has finished a constant speed travel in one direction to a time when it starts a constant speed travel in the counter direction.

Signal (3) represents the operation of the shuttle when the printer is receiving the printing information or when the printer is carrying out a paper-feed, that is, the shuttle is pressed onto one of the dampers and is stopped.

The driver receives the above-described three kinds of control signals and supplies the following driving pulse of the linear motor to the coils of the linear motor.

The operation of the apparatus of FIGS. 5A, 5B and 5C will be illustrated in FIGS. 7 to 16. The waveforms of the driving pulses are illustrated in FIGS. 12 to 14.

Pulse (1): Since the driver unit receives the signal (1) and the shuttle is travelling in one direction or in the counter direction at a constant speed, the driver generates pulses for acceleration or deceleration as the position of the shuttle detected by the sensor is fed back. In this case the length of the pulse (T1, T2, T3, T4) is adjusted so as to keep the speed of the shuttle constant. This is regarded as a constant speed control. FIG. 12 shows the waveforms of the standard pulse, the output of the position sensor and the current supplied to the motor to obtain a constant speed.

Pulse (2): Since the driver receives a signal (2) and the constant speed motion of the shuttle is reversed from one direction to the counter direction, the deceleration pulse is generated until the shuttle reaches the predetermined speed in the other direction. This is regarded as a reversal control. FIG. 14 shows the waveforms of signal (1) or (3) of the position sensor, the current supplied to the motor for a reversal motion and the signal (2) of the position sensor. In the figure, $T_R$ is regarded as a time of excitation for reversal and if the command for a paper feed finish is sent from the microprocessor 22' and a command for a following printing is received, the reversal motion control is carried out, otherwise the stopping control is carried out for a predetermined interval of time. The point $P_Z$ is a point of zero speed or stoppage.

Pulse (3): In order that the driver may receive a signal (3) and the shuttle may be stopped, an acceleration pulse is generated so that the shuttle may be pressed onto the damper mounted at either end of the printing region. This is regarded as a stopping control. FIG. 15 shows the waveforms of the pulse supplied to the motor for a constant speed. The upper part is the waveform of the position sensor (1) and the lower part is that of the position sensor (3). These are selected according to whether the shuttle is stopped at an end of the forwad motion or at the end of a backward motion.

For example, the necessary data for the paper feed and the motion of the shuttle are as follows. The reversal time is 23 msec, the time of constant speed control is 177 msec and the time of the paper feed is 23 msec. In this case, the time of the paper feed contains the feed time and the stationary time for static stopping.

In accordance with the present invention, the third microprocessor generates a stopping signal and sends it to the first and second microprocessor.

Figure 8A:
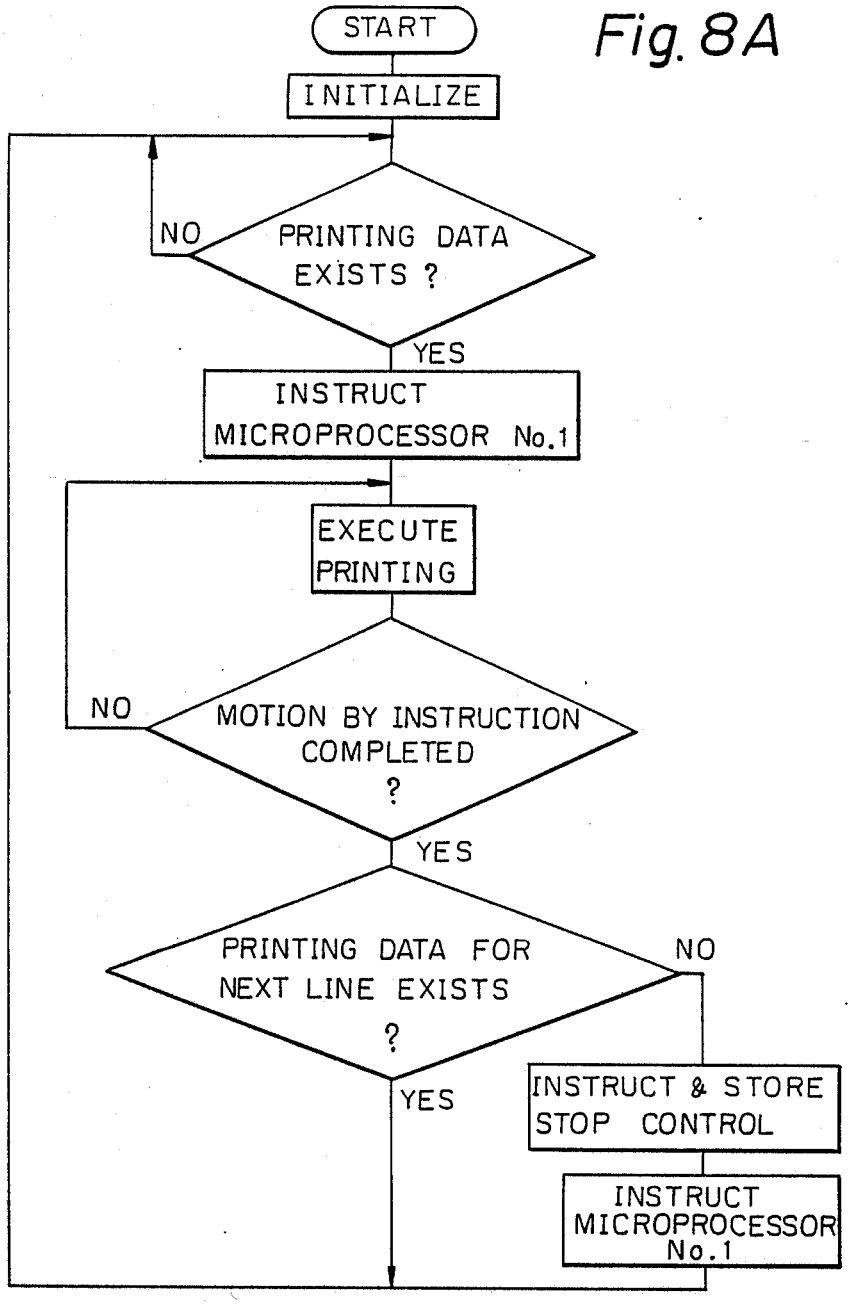
FIGS. 8A and 8B are flow charts which illustrate the flow of the operation in the printer control units shown in FIG. 6.
Figure 8B:
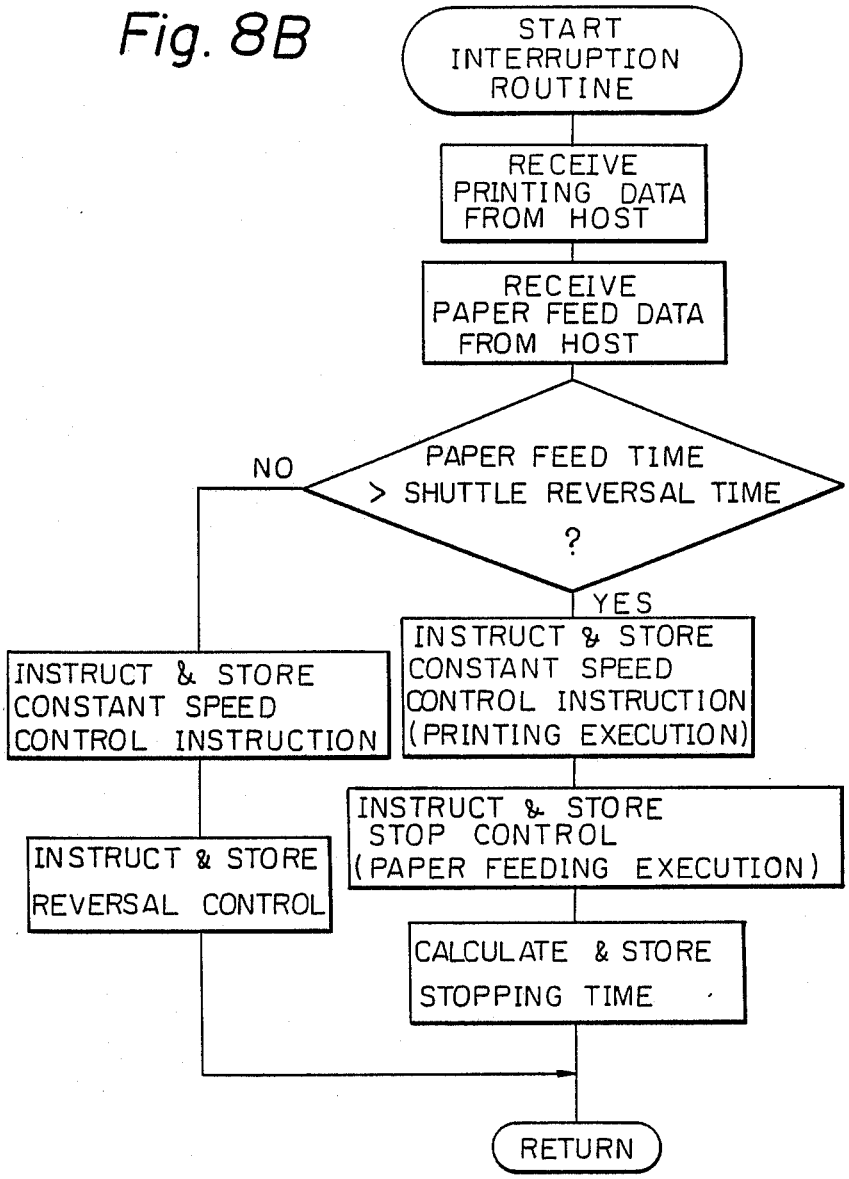

The flow chart of the operation of the third microprocessor in FIG. 6 is shown in FIGS. 8A and 8B which illustrate the flow of the operation in the printer control unit shown in FIG. 6. FIG. 8A shows the existence of printing data and an instruction of microprocessor No. 1.

When printing data is obtained, a command for repeating a regular travel and reversal motion is sent to a first microprocessor. When there is no following printing data, the first microprocessor is so instructed that after a constant speed control of the shuttle has been completed, a stopping control is carried out. Whenever otherwise, when the first and second MPU's receive a paper feed instruction from a host computer, a paper feed is carried out while the shuttle is being reversed, if the paper feed time is shorter than the reversal time of the shuttle. Contrary to this, if it is decided that the paper feed time is longer than the reversal time of the shuttle, the shuttle is stopped after a constant speed control of the shuttle. The stopping time is regarded as the time responsive to the time interval calculated necessary for the paper feed.

When receiving the above-described instructions, the first and second processors generate the above-described instruction signal (1) to (3), and the driver unit supplies the corresponding pulse (1) to (3) to the linear motor coil (FIG. 12).

Figure 16:
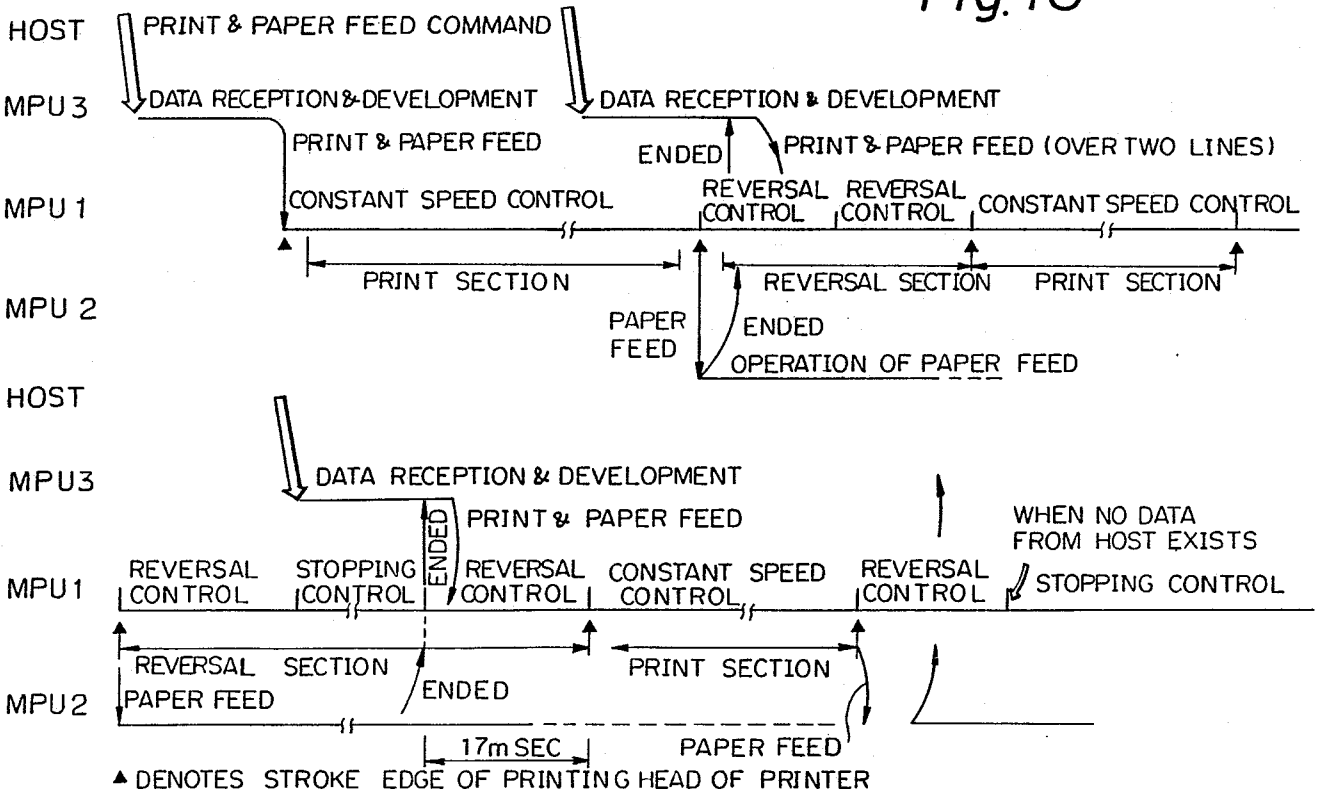
FIG. 16 illustrates the operation of the apparatus of FIG. 5 from one viewpoint.

The operation of the apparatus of FIG. 5 can be illustrated as shown in FIG. 16 as a time chart. The relationship between the command of host computer and the response of MPU 1 to 3 will be clarified in a simple comparison form. The drive unit of the shuttle in the line printer in accordance with the present invention is such that the shuttle may be stopped while awaiting printing data, without which it will be of no use to drive the shuttle, or during a time of paper feeding. Therefore, it is possible to enhance the printing speed of the line printer.

Figures 9, 9A:
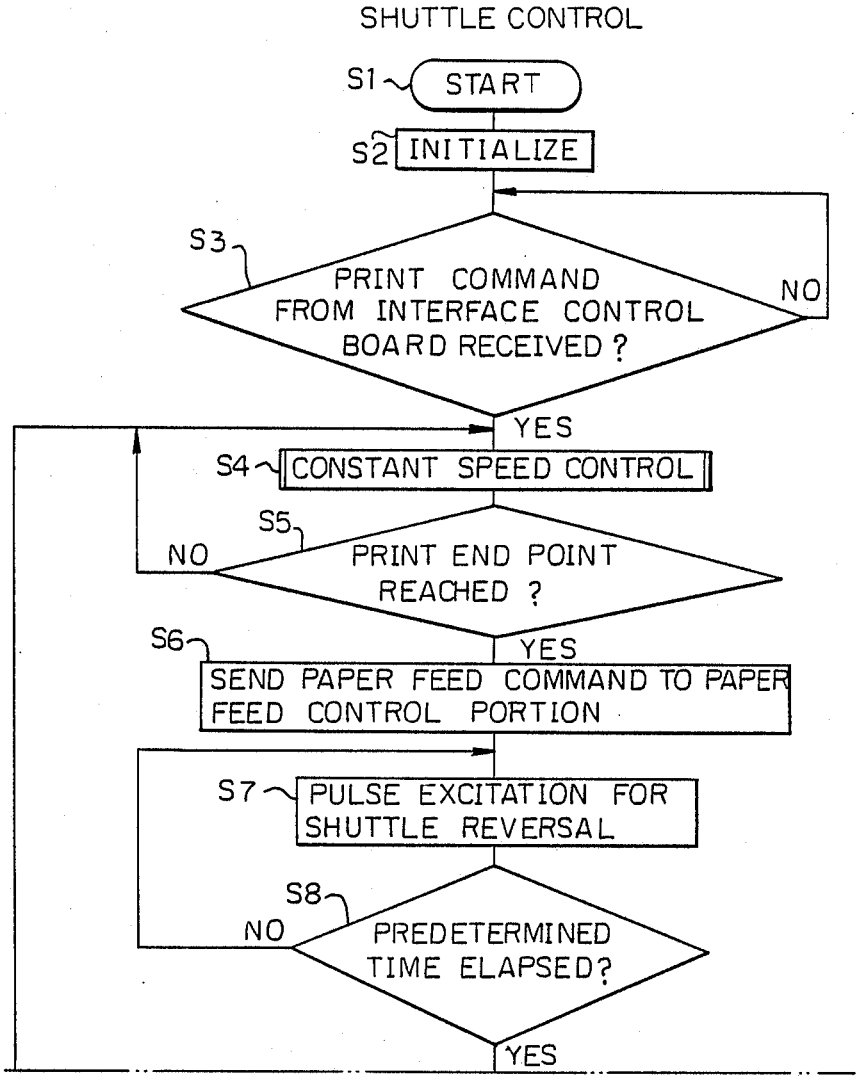
FIGS. 9A and 9B are flow charts of the operation of the shuttle control portion shown in FIG. 5C.
Figure 9B:
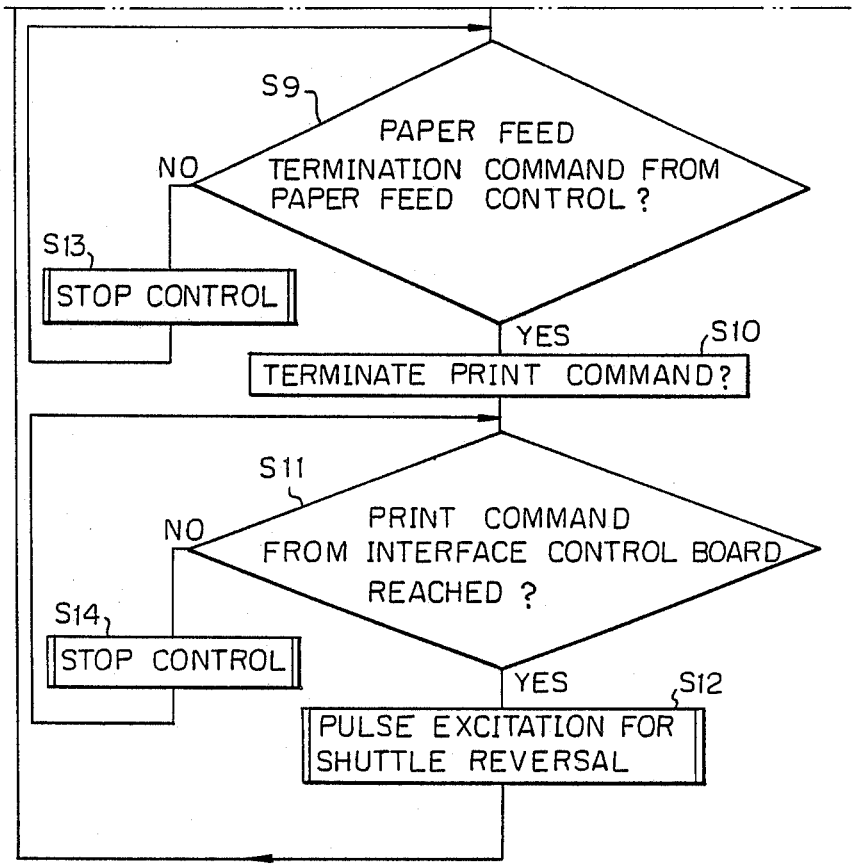
Figure 10:
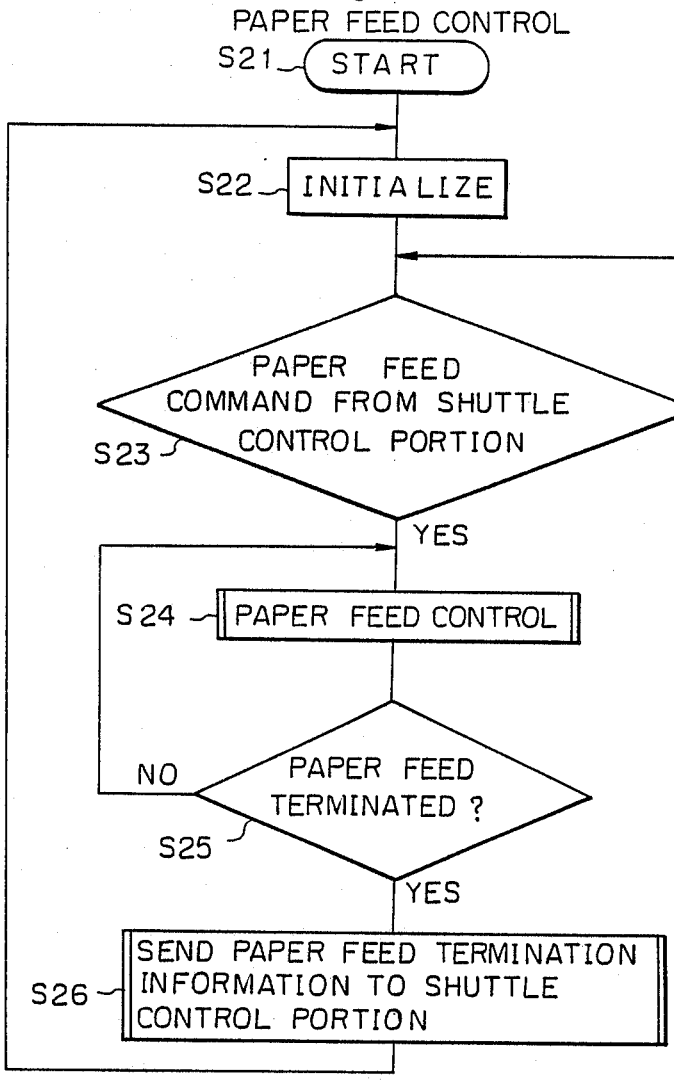
FIG. 10 is a flow chart of the operation of the paper feed control portion shown in FIG. 5C.
Figure 11:
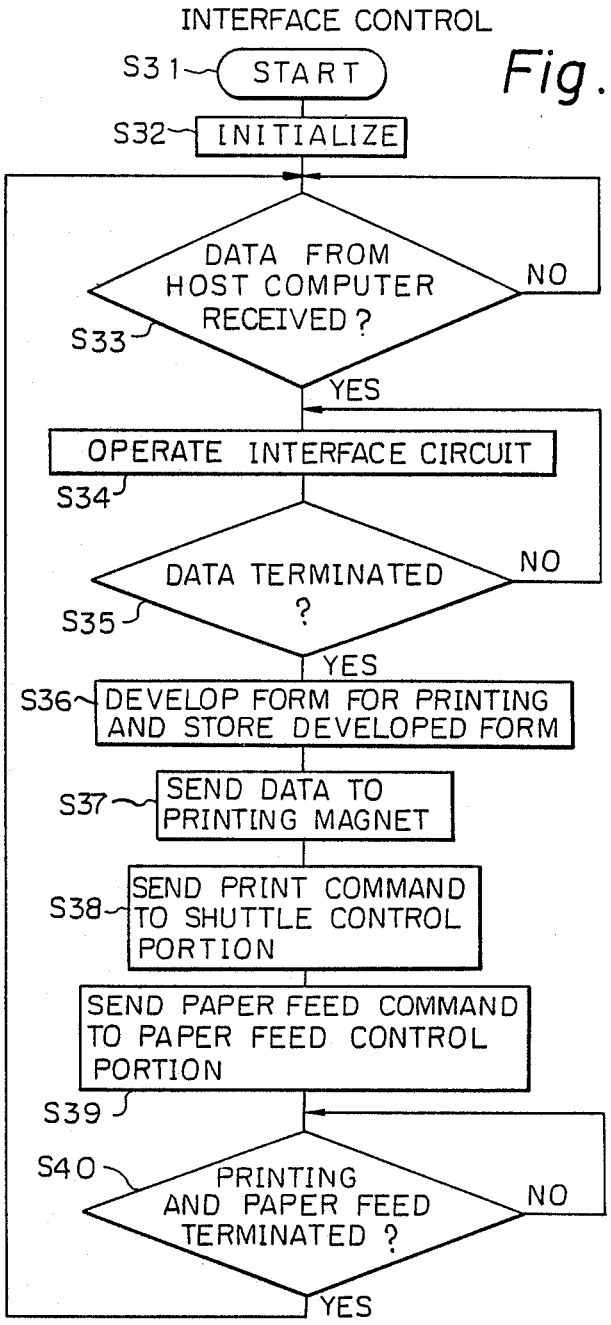
FIG. 11 is a flow chart of the operation of the interface control shown in FIG. 5B.

The operation of the shuttle control portion, the operation of the paper feed control portion, and the operation of the interface control will be described with reference to FIGS. 9 to 11. The operation of the shuttle control portion 211 will be described with reference to FIGS. 9A and 9B. These figures show the flow chart of the shuttle operation in accordance with the present invention, especially the operation of the shuttle and the control of the printer control unit.

When the power supply is turned ON in the printing mechanism 100 and the mechanism controller 21 and 22 starts to run (S1), initialization is carried out and printing starts (S2). Then, whether or not a print command from the interface control board 23 has been sent (S3) is determined. This determination is made by viewing a command/status exchange area. When Yes, the step proceeds to a constant speed motion control (S4). In this case, the output of the position sensor 107 is input from the In-Port and the control signal of the shuttle control portion 211 is sent to the shuttle mechanism 3 via a power amplifier 108 from the Out-Port of the shuttle control portion 211, to drive the shuttle motor. For example, a PLL control (Phase locked loop) may be utilized as the constant speed motion control. Then, when Yes, paper feed data is sent to the paper feed control portion 221 using the signal from a command/-status exchange are 236 (S6). The step S6 is expressed as SEND PAPER FEED COMMAND TO PAPER FEED CONTROL PORTION.

Then, the flow proceeds to a motion reversal control (S7) where a motion reversal control is carried out for a predetermined time. When it is detected that the predetermined time has elapsed (S8), a paper feed termination command is sent from the paper feed control portion 224, and when Yes, the flow proceeds to the next step S10. When No, the flow proceeds to the input of S9 through the step S12 (Motion stop control).

When the paper feed termination command is sent from the paper feed control portion 221 for a predetermined time (that is, for the time interval until the shuttle reaches zero speed) and a print command from the interface control board 23 is still received (S10), the flow proceeds to the step S11 (motion reversal control), where the shuttle motor is excited to effect a reversal motion. When No, the flow proceeds to a motion stop control of the excitation (S13) and returns to the input of S10. When step S11 is finished, the flow returns to the output of S3. When No, the outputs of S3, S5 and S8 return as described in the figure. The operation of the paper feed control portion 221 will be described with reference to FIG. 10.

When the power supply is turned ON and the paper feed control motor 102 starts to run (S21), initialization is carried out (S22). Then, whether or not the paper feed command is sent from the shuttle control portion 211 (S23), is determined. When Yes, the flow proceeds to the paper feed control (S24) where, for example, a pulse motor carries out a closed loop control, and the control signal is sent from the Out-Port to the paper feed motor 112 to drive the motor. Then, the flow proceeds to the next step and whether or not the paper feed has been terminated is determined (S25). When Yes, the paper feed termination data is sent to the shuttle control portion 211 (S26) and the output is returned to the output of step S21. The operation of the interface control 231 will be described with reference to FIG. 11.

When the power supply is turned ON and the interface unit 231 starts to run (S31), initialization is carried out (S32). Then, whether or not data from a host computer has been received is determined (S33). When the determination is carried out and when Yes, data has been received and the interface circuit 232 is utilized (S34). When data for one row is received, the data receive process is terminated (S35), and when Yes, data is sent to the data control unit 233 and the form for printing is developed by using the data control unit 233 and stored in the data control memory 234 (S36). Then, by utilizing the data transfer circuit 235, data is sent to the printing magnet control portion 24 and the output is sent to the magnet driver 110 to drive the pin driving magnet 103. The flow then proceeds to the step S38 where the print command is sent to the shuttle control portion 211 from the command status exchange area 236. When data is ready at the interface control board 23, the paper feed command and the print command are sent to the paper feed control portion 221 (S39) and the termination status of the print and paper feed is determined (S40). When the termination status is terminated, and when Yes, the output is returned to the output of the initialization (S32). When No, the steps S33, S35 and S40 return to the outputs of S32, S33 and S39, respectively.

We claim:

1. A dot matrix printer comprising:

a printing unit carrying a plurality of dot printing elements arranged along a print line;

a drive means for reciprocating said printing unit along said print line, said drive means reciprocating said printing unit through a print section for effecting a dot printing operation and between a pair of reversal sections, one of which is arranged at each stroke end of said print section for reversing the travel direction of said printing unit;

stopper means for providing a stopping position of said printing unit, said stopper means being arranged at the end of each of said reversal sections;

a first control means for effecting a constant speed control for controlling said drive means so that said printing unit moves at a constant speed in said print section, a reversal control for accelerating and decelerating said drive means so that said printing unit carries out a reversal motion in each of said reversal sections, and a stopping control for controlling said drive means so that said printing unit is pressed onto one of said stopper means;

a paper feed means for transferring papers by a line at which a dot printing operation can be carried out by said dot printing elements, in a direction perpendicular to said print line during one of the reversal motions of said printing unit;

an instructing means for instructing said first control means to stop said reversal control, when a command is output to said paper feed means for feeding a plurality of lines of paper continuously, while said printing unit is travelling from said print section to either of said reversal sections and instructing said stopping control of said printing unit; and a releasing means for commanding an instruction to stop said reversal control and to release said stopping control, in correspondence with a timing of termination of the paper feed operation by means of said paper feed means.

2. A dot matrix printer according to claim 1, wherein a transfer time of one line of said paper by said feed means is shorter than a reversal time of said printing unit.

3. A dot matrix printer according to claim 1, wherein said stopper means are dampers.

4. A dot matrix printer according to claim 1, wherein said drive means includes a linear motor.

5. A dot matrix printer according to claim 1, wherein said stopping control includes shuttle stopping means for generating a shuttle drive signal for driving a shuttle carrying the printing unit until the shuttle presses against a damper arranged on either side of the shuttle.

6. A dot matrix printer according to claim 5, wherein said shuttle drive signal is in the form of a pulse excitation signal.

7. A dot matrix printer according to claim 6, which includes a shuttle motor unit and wherein said releasing means restarts to drive the shuttle motor unit on condition that the time necessary to reach a constant speed section is predetermined to carry out a stoppage operation of the shuttle motor unit.

8. A dot matrix printer according to claim 7, wherein said releasing means releases the reversing motion stopping of said stopping control to restart the printing operation earlier, by the time length required for bringing the printing unit in the stopped state to the reversing completed state, than the termination of feeding of the paper.

* * * * *

UNITED STATES PATENT AND TRADEMARK OFFICE

CERTIFICATE OF CORRECTION

PATENT NO. : 4,819,556

DATED : April 11, 1989

INVENTOR(S) : AKIHIRO ABE et al.

It is certified that error appears in the above-identified patent and that said Letters Patent is hereby corrected as shown below:

Column 1, line 45, delete --of--.

Column 3, line 34, after "motor" insert --30--.

Column 5, line 33, delete "FIG. 5" and insert --FIGS. 5A, 5B and 5C--.

Column 7, line 52, "are" should be --area--.

Signed and Sealed this

Twenty-sixth Day of December, 1989

*Attest:*

JEFFREY M. SAMUELS

*Attesting Officer* *Acting Commissioner of Patents and Trademarks*